US006557277B1

(12) United States Patent
Hibi et al.

(10) Patent No.: US 6,557,277 B1
(45) Date of Patent: May 6, 2003

(54) HYDRAULIC CIRCUIT OF WORKING MACHINE

(75) Inventors: Yoshiyuki Hibi, Tokyo (JP); Yorimichi Kubota, Tokyo (JP); Nobuaki Matoba, Tokyo (JP); Shinya Nozaki, Kobe (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/890,876

(22) PCT Filed: Nov. 2, 2000

(86) PCT No.: PCT/JP00/07723

§ 371 (c)(1),
(2), (4) Date: Aug. 7, 2001

(87) PCT Pub. No.: WO01/46527

PCT Pub. Date: Jun. 28, 2001

(30) Foreign Application Priority Data

Dec. 22, 1999 (JP) ..... 11-365441

(51) Int. Cl.[7] ..... E02F 3/34
(52) U.S. Cl. ..... 37/340; 37/187
(58) Field of Search ..... 37/348, 309, 339, 37/340–344, 184–188, 461, 466, 901; 294/68.23, 88; 414/718, 719, 722, 726, 727

(56) References Cited

U.S. PATENT DOCUMENTS 3,574,387 A * 4/1971 Hahn ..... 294/106
5,375,348 A * 12/1994 Kishi ..... 37/186
5,540,005 A * 7/1996 Lynch ..... 294/68.23

FOREIGN PATENT DOCUMENTS

JP 8-246490 9/1996
JP 11-270505 10/1999

* cited by examiner

*Primary Examiner*—Robert E. Pezzuto
(74) *Attorney, Agent, or Firm*—Morrison & Foerster LLP

(57) ABSTRACT

A hydraulic circuit for a working machine is provided which prevents a decrease in the working speed of a clamshell bucket upon expansion of an expansion arm, so that improvement of the operability can be achieved. A hydraulic circuit for a working machine is configured such that a clamshell bucket is attached to a tip end of an expansion arm and the expansion arm and the clamshell bucket are operated by pressure oil supplied from a common pressure source. The operating pressure is reduced for driving the expansion arm to the expansion side based on the operating pressure for opening the clamshell bucket. By the configuration, the clamshell bucket can be opened rapidly, and improvement of the operability is achieved.

9 Claims, 8 Drawing Sheets

3a: BOOM CYLINDER
4: MULTISTAGE EXPANSION ARM
4a: ARM CYLINDER
5: CLAMSHELL BUCKET
5a: BUCKET CYLINDER
6: PRIME MOVER
8: CONTROL VALVE UNIT
9: REVOLVING MOTOR
10a: TRAVELING MOTOR
11: TELESCOPIC CYLINDER
12: SLOW RETURN VALVE
13: TELESCOPIC CONTROL VALVE
14: BUCKET CONTROL VALVE
15,16: REMOTE CONTROL LEVER
15a,15b: REMOTE CONTROL VALVE
16a,16b: REMOTE CONTROL VALVE
17: TANK
20: PRESSURE REDUCING VALVE
21: EXTERNAL PILOT TYPE PRESSURE REDUCING VALVE

22: PRESSURE DETECTOR
23: SOLENOID CONTROLLED PROPORTINAL PRESSURE REDUCING VALVE
24: CONTROLLER
25: PRESSURE SETTER
26: SOLENOID VALVE DRIVER

35: REGENERATION VALVE
36: CONFLUENCE CHECK VALVE

1 : LOWER TRAVELING UNIT
2 : UPPER REVOLVING UNIT
3 : BOOM
3a : BOOM CYLINDER
4 : MULTISTAGE EXPANSION ARM
4a : ARM CYLINDER
5 : CLAMSHELL BUCKET

HYDRAULIC CIRCUIT OF WORKING MACHINE

TECHNICAL FIELD

This invention relates to a hydraulic circuit for a working machine such as a hydraulic excavator, and more particularly to a hydraulic circuit for a working machine suitable for use with a working machine based on a hydraulic excavator and having a multistage expansion arm for caisson type excavation.

BACKGROUND ART

FIG. 8 is a schematic side elevational view showing a hydraulic excavator (working machine) to which a common multistage expansion arm is attached. The hydraulic excavator includes a lower traveling unit 1, an upper revolving unit 2 coupled for revolution to the lower traveling unit 1, a boom 3 mounted for swinging motion on the upper revolving unit 2, a multistage expansion arm (expansible arm) 4 mounted for swinging motion at a tip end of the boom 3 and having an expansion/contraction function, a clamshell bucket 5 mounted at a tip end of the multistage expansion arm 4, and so forth.

A boom cylinder 3*a* is provided between the boom 3 and the upper revolving unit 2, and the boom 3 is driven to swing in response to an expansion/contraction movement of the boom cylinder 3*a*. Similarly, an arm cylinder 4*a* is provided between the boom 3 and the multistage expansion arm 4, and the multistage expansion arm 4 is driven to swing in response to an expansion/contraction movement of the arm cylinder 4*a*. It is to be noted that a cylinder 11 [refer to FIG. 9] is provided for the multistage expansion arm 4 and can expand and contract the multistage expansion arm 4.

The clamshell bucket 5 is configured for opening and closing movement by causing a hydraulic cylinder 5*a* [refer to FIG. 9] provided in the inside thereof to operate.

FIG. 9 is a schematic view showing a general configuration of a hydraulic circuit for the hydraulic excavator described above. It is to be noted that a pilot circuit is not shown in FIG. 9. Referring to FIG. 9, reference numeral 6 denotes a prime mover, reference characters 7*a*, 7*b* denote each a hydraulic pump (pressure source) driven by the prime mover 6, and reference numeral 8 denotes a control valve unit for controlling pressure oil (operating oil) from the hydraulic pumps 7*a*, 7*b* to distribute the flow rates of the pressure oil to various actuators which are hereinafter described. Reference numeral 9 denotes a revolving motor for driving the revolving motor 9, and reference characters 10*a*, 10*b* denote each a traveling motor for driving a traveling apparatus not shown provided on the lower traveling unit 1.

Reference character boom cylinder 3*a* denotes a boom cylinder, 4*a* an arm cylinder, 5*a* a bucket cylinder for opening and closing the clamshell bucket, 11 a telescopic cylinder for expanding and contracting the multistage expansion arm 4, 12 a slow return valve provided in a rod side chamber 11*b* of the telescopic cylinder 11, and 17 a tank.

When operating oil is supplied into a hydraulic chamber at an upper portion in the figure of the bucket cylinder 5*a* to move the bucket cylinder 5*a* downwardly in the figure, the clamshell bucket 5 is opened. A restrictor (orifice) is formed in the inside of the slow return valve 12 and prevents sudden expansion of the multistage expansion arm 4 by its own weight.

Reference numeral 13 denotes a telescopic control valve for expanding or contracting the telescopic cylinder 11 built in the control valve unit 8, 14 a bucket control valve for operating the bucket cylinder 5*a*, reference characters 15*a*, 15*b* denote each a telescopic remote control valve for controlling the telescopic control valve 13, reference numeral 15 denotes a telescopic remote control lever for controlling movement of the telescopic remote control valves 15*a*, 15*b*, valves 16*a*, 16*b* are bucket remote control valves for controlling the bucket control valve 14, and reference numeral 16 denotes a bucket remote control valve for controlling operation of the bucket remote control valves 16*a*, 16*b*.

Of the components given above, the telescopic remote control valve 15*a* is a remote control valve (opening operator) for expanding the telescopic cylinder 11, and when the telescopic remote control lever 15 is tilted rightwardly in the figure, the telescopic remote control valve 15*a* is opened and a pilot pressure corresponding to the operation amount of the telescopic remote control lever 15 is outputted.

The bucket remote control valve 16*a* is a remote control valve (opening operator) for causing the clamshell bucket 5 to perform an opening movement, and when the bucket remote control lever 16 is tilted rightwardly in the figure, the bucket remote control valve 16*a* is opened and a pilot pressure corresponding to the operation amount of the bucket remote control lever 16 is outputted.

Reference characters 103*a*, 104*a*, 109, 110*a*, 110*b* denote control valves for controlling movement of the boom cylinder 3*a*, arm cylinder 4*a*, revolving motor 9, and traveling motors 10*a*, 10*b*, respectively, and reference numeral 120 denotes a traveling straightforward valve for keeping straightforward traveling of the hydraulic excavator. It is to be noted that detailed description of the valves just mentioned is omitted.

Referring to FIG. 9, if the telescopic remote control lever 15 is operated to open the telescopic remote control valve 15*a*, then a pilot pressure acts upon a pilot port 13*a* to change over the telescopic control valve 13 of the control valve unit 8 from a chamber N to another chamber X. Then, pressure oil is supplied from the hydraulic pumps 7*a*, 7*b* into a head side chamber 11*a* of the telescopic cylinder 11 while pressure oil in the rod side chamber 11*b* is introduced into the tank 17 through the slow return valve 12 and the telescopic control valve 13.

At this time, since the weights of the multistage expansion arm 4 and the clamshell bucket 5 themselves act in the rod side chamber 11*b* of the telescopic cylinder 11, a high pressure is generated in the rod side chamber 11*b*, but the pressure in the head side chamber 11*a* becomes low since no load is applied to the head side chamber 11*a*.

Accordingly, if the bucket remote control lever 16 is operated in order to open the clamshell bucket 5 while the multistage expansion arm 4 is being extended, then most of pressure oil in the hydraulic pumps 7*a*, 7*b* flows into the head side chamber 11*a* of the telescopic cylinder 11 which has a lower working pressure. Consequently, sufficient pressure oil is not supplied into the bucket cylinder 5*a* and the speed at which the clamshell bucket 5 is opened is reduced, resulting in a subject that the operability is deteriorated.

The present invention has been made in view of such a subject as just described, and it is an object of the present invention to provide a hydraulic circuit for a working machine which prevents drop of the working speed of a clamshell bucket upon expansion of an expansion arm so that improvement in operability is achieved.

DISCLOSURE OF THE INVENTION

In order to attain the object described above, according to an aspect of the present invention, a hydraulic circuit for a working machine which includes an expansion arm and a clamshell bucket attached to a tip end of the expansion arm and is configured such that the expansion arm and the clamshell bucket are operated by pressure oil supplied from a common pressure source is characterized in that it comprises pressure reduction means for reducing an operating pressure for driving the expansion arm to the expansion side based on an operating pressure for opening the clamshell bucket.

Accordingly, with the hydraulic circuit for a working machine of the present invention, when an operation for opening the clamshell bucket is performed while the expansion arm is being expanded by reducing the operating pressure for driving the expansion arm to the expansion side based on the operating pressure for opening the clamshell bucket, supply of pressure oil for driving the expansion arm to the expansion side is limited so that the supply amount of pressure oil to the clamshell bucket can be increased as much. Consequently, the clamshell bucket can be opened rapidly, and the subject that the speed at which the clamshell bucket is opened is low can be solved and improvement of the operability can be achieved.

Preferably, the pressure reduction means includes first pressure reduction means for reducing the operating pressure for opening the clamshell bucket and outputting the reduced operating pressure, and second pressure reduction means for reducing the operating pressure for driving the expansion arm to the expansion side based on the output pressure from the first pressure reduction means.

By the configuration, similar advantages to those described above can be achieved. Further, there is an another advantage that the present apparatus can be provided readily at a low cost.

Preferably, the pressure reduction means includes operating pressure detection means for detecting the operating pressure for opening the clamshell bucket, and third pressure reduction means for reducing the operating pressure for driving the expansion arm to the expansion side based on detection information from the operating pressure detection means.

By the configuration, similar advantages to those described above can be achieved. Further, since it is necessary to add only one pressure reduction means as a hydraulic apparatus to a common hydraulic circuit, there is an another advantage that the present apparatus can be provided readily at a low cost similarly.

It is to be noted that, in this instance, further preferably the third pressure reduction means is set so that, as the operating pressure detected by the operating pressure detection means increases, the operating pressure for driving the expansion arm to the expansion side is reduced as much.

According to another aspect of the present invention, a hydraulic circuit for a working machine which includes an expansion arm and a clamshell bucket attached to a tip end of the expansion arm is characterized in that it comprises a regeneration valve interposed between a working cylinder of the expansion arm and an output pressure supply path of the opening side of the clamshell bucket, when the expansion arm is driven to the expansion side, and capable of supplying returning pressure oil from the working cylinder to the output pressure supply path, and a directional control valve for being changed over, in response to an operating pressure for driving the expansion arm to the expansion side, so that an opening operating pressure for opening the clamshell bucket is supplied as a driving operating pressure for the regeneration valve to the regeneration valve to change over a working condition of the regeneration valve.

Accordingly, there is an advantage that, when the operation for expanding the expansion arm and the operation for opening the clamshell bucket are performed in an interlocking relationship, the opening speed of the clamshell bucket can be increased without decreasing the expansion speed of the expansion arm. Consequently, there is another advantage that the subject, that the opening speed of the clamshell bucket is low, can be solved and improvement in operability can be achieved.

Preferably, the directional control valve has a non-response zone within which the driving operating pressure is not supplied to the regeneration valve within a region within which the operating pressure for driving the expansion arm to the expansion side is lower than a predetermined pressure. By such configuration, the expansion arm can be prevented from being expanded suddenly.

Further preferably, the directional control valve is set such that, in another region wherein the operating pressure for driving the expansion arm is higher than the predetermined pressure, the driving operating pressure to be supplied to the regeneration valve increases in response to an increase of the operating pressure for driving the expansion arm to the expansion side. By such configuration, as the operating pressure for expanding the expansion arm increases, the clamshell bucket can be opened at a higher speed.

The regeneration valve may be configured such that, as the driving operating pressure supplied from the directional control valve increases, the amount of returning pressure oil to be supplied from the working cylinder to the output pressure supply path increases. Where the regeneration valve is configured in this manner, sudden expansion of the expansion arm within the region, wherein the driving operating pressure is low, is prevented, and in the region wherein the driving operating pressure is high, the clamshell bucket can be opened rapidly.

According to a further aspect of the present invention, a hydraulic circuit for a working machine which includes an expansion arm and a clamshell bucket attached to a tip end of the expansion arm is characterized in that it comprises a regeneration valve interposed between a working cylinder of the expansion arm and an output pressure supply path of the opening side of the clamshell bucket, and capable of supplying returning pressure oil from the working cylinder when the expansion arm is driven to the expansion side to the output pressure supply path, and that the working condition of the regeneration valve is controlled based on an operating pressure for driving the expansion arm to the expansion side.

Accordingly, by controlling the working condition of the regeneration valve based on the operating pressure for driving the expansion arm to the expansion side, there is an advantage that, when the operation for expanding the expansion arm and the operation for opening the clamshell bucket are performed in an interlocking relationship, the opening speed of the clamshell bucket can be increased without decreasing the expansion speed of the expansion arm.

Consequently, there is another advantage that the subject that the opening speed of the clamshell bucket is low can be solved and improvement in operability can be achieved.

BEST MODE FOR CARRYING OUT THE INVENTION

In the following, embodiments of the present invention are described with reference to the drawings.

(A) Description of the First Embodiment

Figure 1:
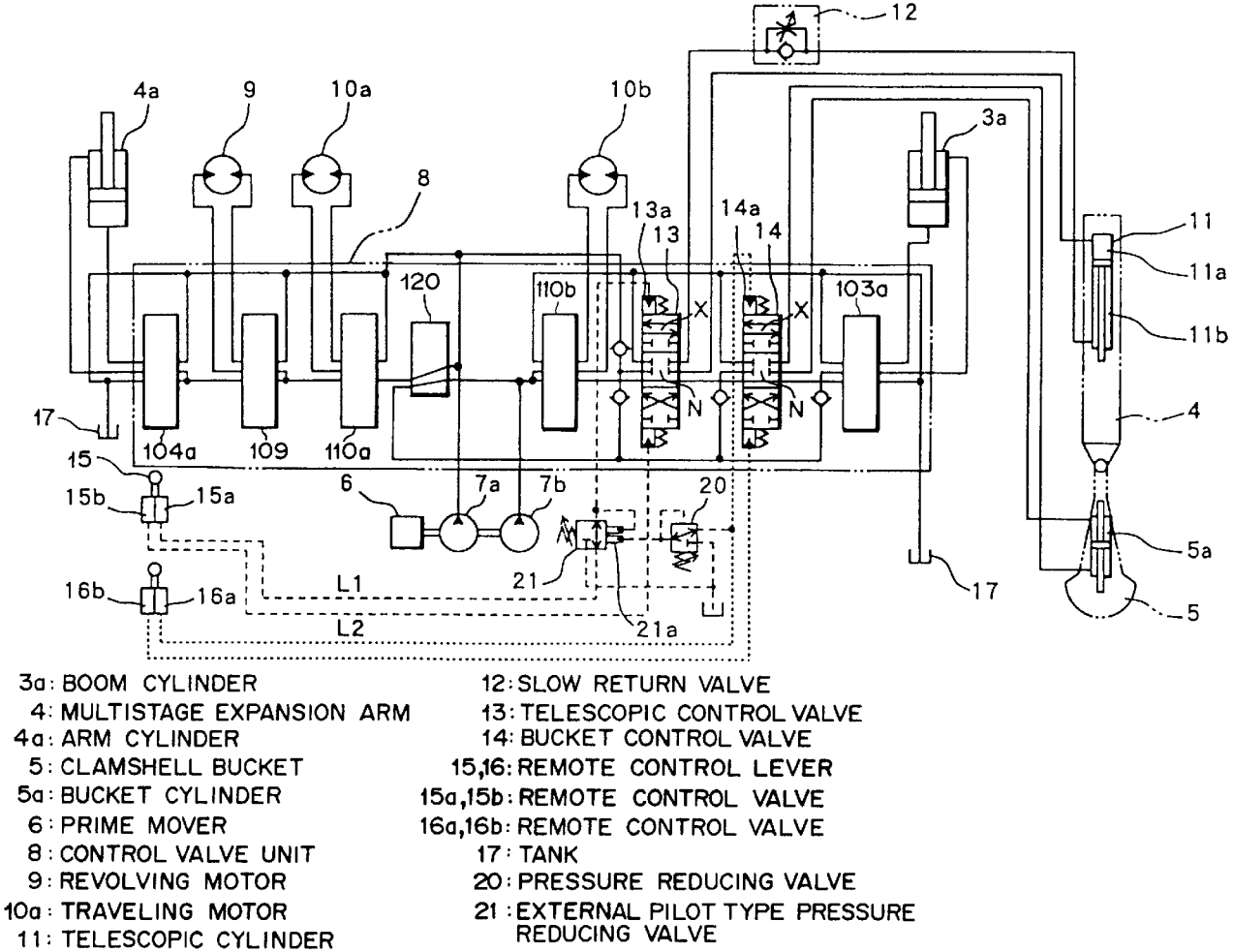
FIG. 1 is a schematic view showing a general configuration of a hydraulic circuit for a working machine according to a first embodiment of the present invention.

First, a hydraulic circuit for a working machine according to a first embodiment of the present invention is described. FIG. 1 is a schematic view showing a general configuration of the hydraulic circuit.

Figure 9:
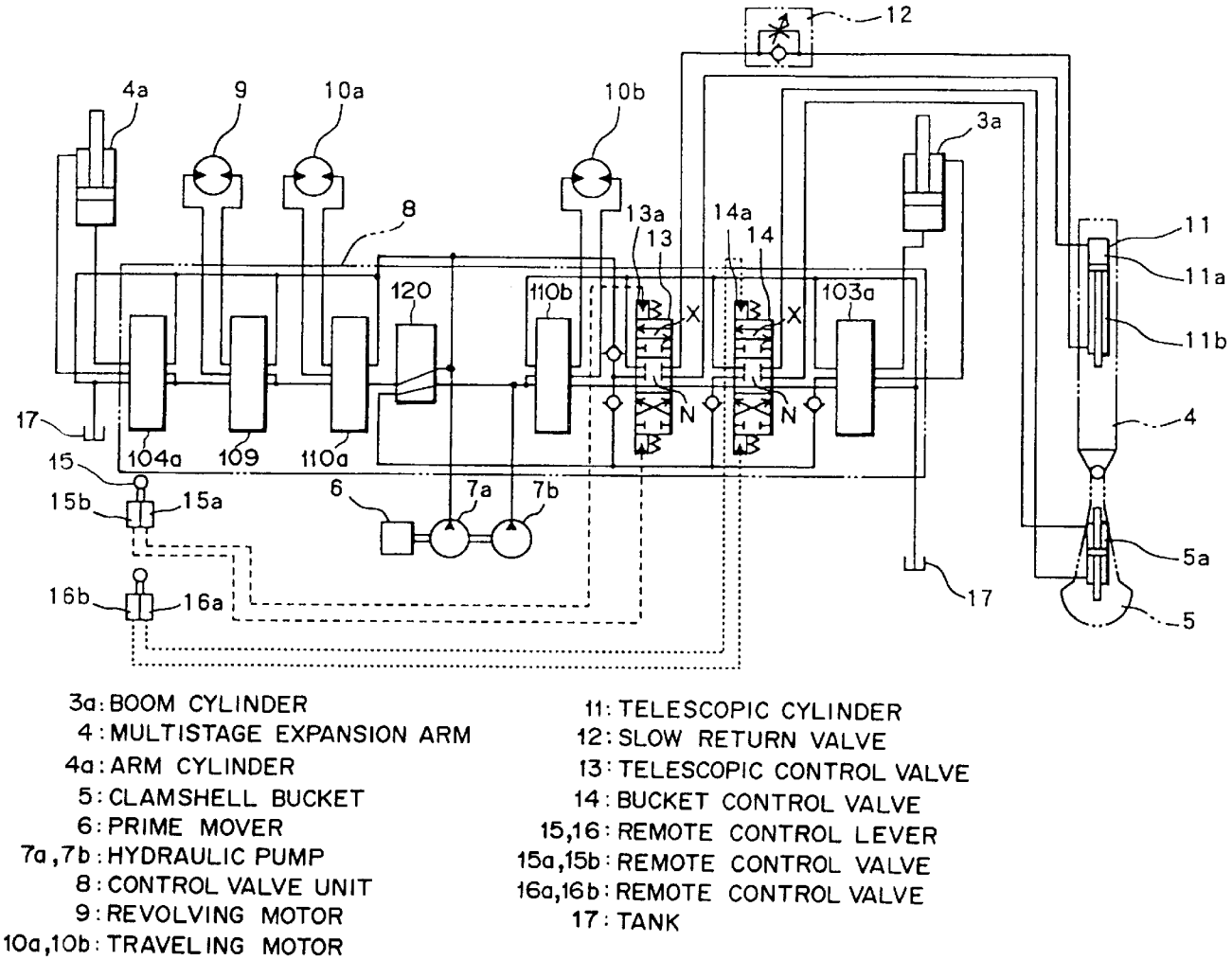
FIG. 9 is a schematic view showing a general configuration of a hydraulic circuit for a hydraulic excavator to which a common multistage expansion arm is attached.

In the hydraulic circuit of the first embodiment of the present invention, the basic configuration of the apparatus is similar to that of the hydraulic circuit shown in FIG. 9, and elements described with reference to FIG. 9 are denoted by like reference characters and description of them is omitted.

The hydraulic circuit of the first embodiment includes, as shown in FIG. 1, in addition to the general configuration shown in FIG. 9, a pressure reducing valve (first pressure reduction means) 20 for reducing the pilot pressure (operating pressure) from the bucket remote control valve (opening operator) 16*a*, and an external pilot type pressure reducing valve (second pressure reduction means) 21 provided for a pilot circuit on the expansion side of the telescopic cylinder (working cylinder) 11.

The external pilot type pressure reducing valve 21 has a set pressure controlled in accordance with an output pressure of the pressure reducing valve 20, and when the output pressure of the pressure reducing valve 20 is lowest (for example, when the bucket remote control lever 16 is not operated), the output pressure from the telescopic remote control valve 15*a* is set to a high pressure without pressure reduction. On the other hand, if the bucket remote control valve 16*a* is operated by the bucket remote control lever 16 and the output pressure of the pressure reducing valve 20 is increased, then the operation of the external pilot type pressure reducing valve 21 is controlled in accordance with the pressure to reduce the pilot pressure of the remote control valve 15*a*.

Then, if the output pressure of the pressure reducing valve 20 becomes equal to or greater than a predetermined value, then the pilot pressure to the telescopic control valve 13 does not become equal to or greater than a prescribed pressure.

Since the hydraulic circuit for a working machine according to the first embodiment of the present invention is configured in such a manner as described above, it operates in the following manner. It is to be noted that the following description is given separately of operation of the hydraulic circuit when the telescopic cylinder 11 operates by itself and operation when the telescopic cylinder 11 and the bucket cylinder 5*a* operate in an interlocking relationship.

(1) Operation of the Telescopic Cylinder by Itself

Referring to FIG. 1, if the telescopic remote control lever 15 is operated to open the telescopic remote control valve 15*a*, then the pilot pressure (operating pressure) is introduced to the pilot port 13*a* of the telescopic control valve 13 through a pipe L1 and the external pilot type pressure reducing valve 21, and the telescopic control valve 13 is changed over from the chamber N to the chamber X. Consequently, pressure oil in the hydraulic pumps (pressure source) 7*a*, 7*b* is supplied into the head side chamber 11*a* of the telescopic cylinder 11.

Meanwhile, pressure oil in the rod side chamber 11*b* of the telescopic cylinder 11 is introduced into the tank 17 through the slow return valve 12 and the chamber X of the telescopic control valve 13 to expand the telescopic cylinder 11.

At this time, if the bucket remote control lever 16 is not operated, then the output pressure of the pressure reducing valve 20 becomes the lowest pressure, and the external pilot type pressure reducing valve 21 is set to the highest pressure. Accordingly, the pilot pressure of the telescopic remote control valve 15*a* is introduced to the pilot port 13*a* of the telescopic control valve 13 without being reduced to fully open the valve 13, and consequently, the full flow amounts of the hydraulic pumps 7*a*, 7*b* are supplied into the head side chamber 11*a* of the telescopic cylinder 11 so that the telescopic cylinder 11 can be expanded at the highest speed.

(2) Interlocking Operation of the Telescopic Cylinder and the Bucket Cylinder

As shown in FIG. 1, the hydraulic circuits for the telescopic cylinder 11 for the multistage expansion arm (expansion arm) 4 and the cylinder 5*a* for the clamshell bucket 5 are connected in parallel, and if the bucket cylinder 5*a* is operated simultaneously with an operation of the telescopic cylinder 11 to the expansion side, then pressure oil tends to flow only into the telescopic cylinder 11 whose pressure is lower. In this instance, the present embodiment operates in the following manner.

Namely, if the bucket remote control valve 16*a* operates when the bucket remote control valve 16*a* is operated, then the pilot pressure is introduced to a pilot port 14*a* of the bucket control valve 14 through a pipe L2 so that the bucket control valve 14 is changed over from the chamber N to the chamber X and the pilot pressure is introduced also into the pressure reducing valve 20.

The pilot pressure of the bucket remote control valve 16*a* is reduced (controlled to a pressure within a prescribed pressure) by the pressure reducing valve 20 and outputted to a pilot port 21*a* of the external pilot type pressure reducing valve 21. Consequently, as the operation amount of the bucket remote control valve 16*a* increases, the set pressure of the external pilot type pressure reducing valve 21 drops from the highest pressure to the prescribed pressure.

Accordingly, upon the opening movement of the bucket remote control valve 16*a*, the pilot pressure of the telescopic remote control valve 15*a* is reduced by the external pilot type pressure reducing valve 21 so that the pilot pressure of the telescopic control valve 13 is controlled so as not to increase equal to or greater than the prescribed pressure.

As a result, the stroke of the telescopic control valve 13 is limited to a predetermined stroke by the reduced pilot pressure, and the opening area of the telescopic control valve 13, interposed between the hydraulic pumps 7*a*, 7*b* and the telescopic cylinder 11, is restricted to increase the pump pressure. Consequently, the expansion speed of the telescopic cylinder 11 decreases and the supply flow rate from the bucket control valve 14 to the bucket cylinder 5*a* increases, thereby increasing the opening speed of the clamshell bucket 5.

By the operation described above, when an operation for opening the clamshell bucket 5 is performed while the multistage expansion arm 4 is being expanded, pressure oil can be supplied with certainty to the clamshell bucket 5 while limiting supply of pressure oil to the telescopic cylinder 11, and therefore, the clamshell bucket 5 can be opened rapidly. Consequently, the subject described in the background art hereinabove that the speed at which the clamshell bucket 5 is opened is low can be solved and improvement of the operability can be achieved. Further, since only it is necessary to add the two pressure reducing valves 20, 21 to the common configuration, there is an advantage that the present apparatus can be provided readily at a comparatively low cost.

(B) Description of the Second Embodiment

Figure 2:
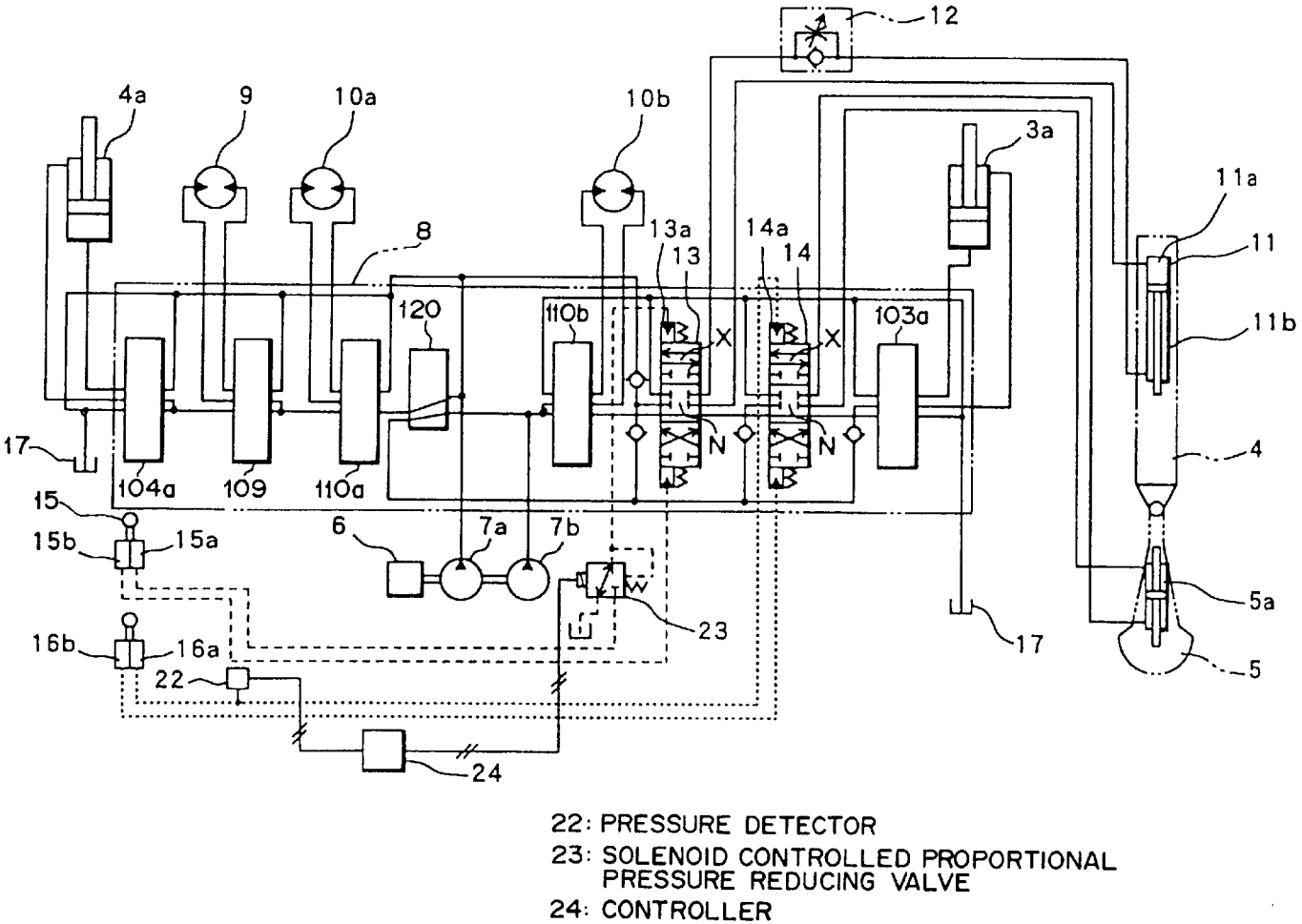
FIG. 2 is a schematic view showing a general configuration of a hydraulic circuit for a working machine according to a second embodiment of the present invention.

Now, a hydraulic circuit for a working machine according to a second embodiment of the present invention is described. FIG. 2 is a schematic view showing a general configuration of the hydraulic circuit, and FIG. 3 is a schematic block diagram showing a configuration of control means of the hydraulic circuit.

The present second embodiment has a basic configuration similar to that of the hydraulic circuit shown in FIG. 9 and includes, as shown in FIG. 2, in addition to the configuration shown in FIG. 9, a pressure detector (operating pressure detection means) 22 provided at the output port of the bucket remote control valve (opening operator) 16*a*, a solenoid controlled proportional pressure reducing valve (third pressure reduction means) 23 provided between the telescopic remote control valve 15*a* and the pilot port 13*a* of the telescopic control valve 13, and a controller (control means) 24 for outputting a driving signal to the solenoid controlled proportional pressure reducing valve 23 based on a signal of the pressure detector 22. It is to be noted that those elements described hereinabove with reference to FIG. 9 are denoted by like reference characters and description of them is omitted.

Figure 3:
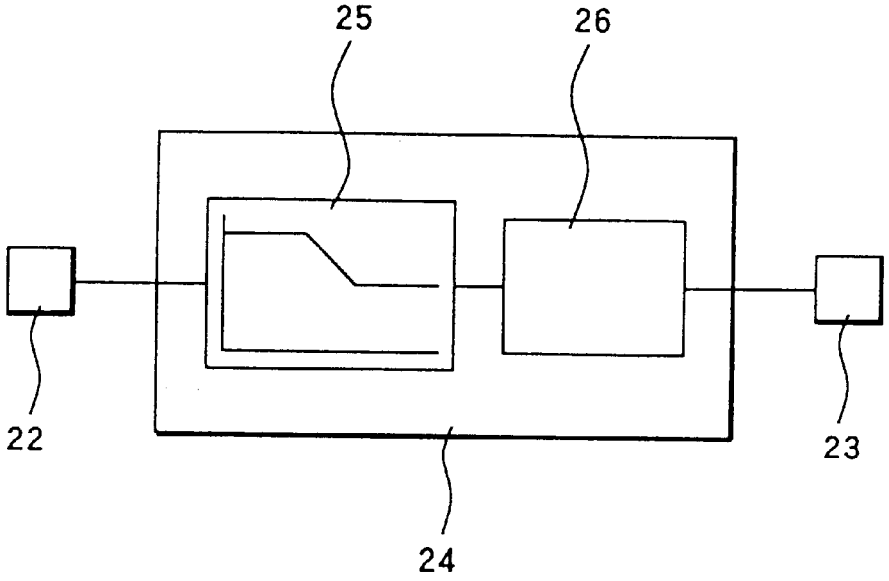
FIG. 3 is a schematic block diagram showing a configuration of control means of the hydraulic circuit for a working machine according to the second embodiment of the present invention.

Further, as shown in FIG. 3, a pressure setter 25, for outputting a set pressure of the solenoid controlled proportional pressure reducing valve 23 based on a signal of the pressure detector 22, and a solenoid valve driver 26, for outputting driving current for the solenoid controlled proportional pressure reducing valve 23 based on a set pressure signal outputted from the pressure setter 25, are provided in the controller 24.

Here, a characteristic of the pressure setter 25 is described briefly. The pressure setter 25 is basically set so that, when the pilot pressure (operating pressure) of the bucket remote control valve 16*a* is low, the set pressure of the solenoid controlled proportional pressure reducing valve 23 is high.

FIG. 3 illustrates an example of characteristic of the pressure setter 25. When the pilot pressure is within a certain range, the set pressure of the solenoid controlled proportional pressure reducing valve 23 decreases linearly in response to an increase of the pilot pressure of the remote control valve 16*a*. Further, where the pilot pressure is equal to or smaller than the range, the set pressure is fixed to the highest value therefor, but where the pilot pressure is equal to or greater than the range, the set pressure is fixed to the lowest value therefor.

The hydraulic circuit for a working machine according to the second embodiment of the present invention is configured in such a manner as described above, and operation of the hydraulic circuit is described below separately for a case wherein the telescopic cylinder 11 operates by itself and another case wherein the telescopic cylinder 11 and the bucket cylinder 5*a* operate in an interlocking relationship.

(1) Operation of the Telescopic Cylinder by Itself

First, if the telescopic remote control valve 15*a* is opened while the bucket remote control lever 16 is not in an operation state (when the bucket remote control valve 16*a* is closed), then the pilot pressure from the telescopic remote control valve 15*a* is introduced to the solenoid controlled proportional pressure reducing valve 23.

At this time, since the pilot pressure of the remote control valve 16*a* detected by the pressure detector 22 has the lowest value, the pressure setter 25 outputs a signal to make the pilot pressure of the bucket remote control valve 16*a* the highest pressure, and the solenoid controlled proportional pressure reducing valve 23 is driven through the solenoid valve driver 26.

Consequently, the pilot pressure of the telescopic remote control valve 15*a* is outputted, for example, as it is without being reduced and is introduced to the pilot port 13*a* of the telescopic control valve 13. As a result, the full flow amounts of the hydraulic pumps 7*a*, 7*b* are supplied to the telescopic cylinder 11 through the telescopic control valve 13, and consequently, the telescopic cylinder 11 can be expanded at the highest speed.

(2) Interlocking Operation of the Telescopic Cylinder and the Bucket Cylinder

When the bucket remote control valve 16*a* is opened, the pilot pressure of the bucket remote control valve 16*a* is detected by the pressure detector 22, and a control signal for the solenoid controlled proportional pressure reducing valve 23 is set by the pressure setter 25.

Then, if the bucket remote control valve 16*a* is operated to its fully open state, then the output of the solenoid controlled proportional pressure reducing valve 23 is gradually decreased from the highest pressure to the prescribed pressure in response to an increase of the pilot pressure.

Accordingly, the pilot pressure of the telescopic remote control valve 15*a* is limited to the prescribed pressure by the solenoid controlled proportional pressure reducing valve 23, and the reduced pilot pressure is outputted to the pilot port 13*a* of the telescopic control valve 13.

As a result, the stroke of the telescopic control valve 13 is limited to a predetermined stroke corresponding to the reduced pilot pressure, and consequently, the opening area of the telescopic control valve 13 interposed between the hydraulic pumps 7*a*, 7*b* and the telescopic cylinder 11 is restricted to increase the pump pressure. Accordingly, the supply flow rate of operating oil from the bucket control valve 14 to the bucket cylinder 5*a* increases, thereby increasing the opening speed of the clamshell bucket 5.

By the operation described above, similarly as in the first embodiment described hereinabove, if an operation for opening the clamshell bucket 5 while expanding the multistage expansion arm 4, then the clamshell bucket 5 can be opened rapidly. Consequently, the subject described in the background art hereinabove that the speed at which the clamshell bucket 5 is opened is low can be solved and improvement of the operability can be achieved. Further, since only it is necessary to add the pressure reducing valve 23 as a hydraulic equipment to the hydraulic circuit shown in FIG. 9, there is an advantage that the present apparatus can be provided readily at a comparatively low cost.

It is to be noted that the hydraulic circuit may be configured otherwise such that a plurality of characteristic of the pressure setter 25 of the controller 24 are stored in a memory not shown and the characteristic of the pressure setter 25 is suitably changed in accordance with the working situation or the attached clamshell bucket or the like.

Consequently, since the signal of the solenoid controlled proportional pressure reducing valve 23 can be set freely by the controller 24 based on the signal of the pressure detector 22, the hydraulic circuit is advantageous in that, when the bucket 5 of a different weight is attached, or the different cylinder 11 is attached, adjustment of the speed can be performed more readily than that in the first embodiment and operation adjustment is simplified.

Further, the characteristic of the pressure setter 25 is not limited to that illustrated in FIG. 3, but can be set to various other characteristic only if the pressure setter 25 has such a characteristic that the set pressure of the solenoid controlled proportional pressure reducing valve 23 is reduced in response to an increase of the pilot pressure of the telescopic remote control valve 16*a*.

(C) Description of the Third Embodiment

Figure 4:
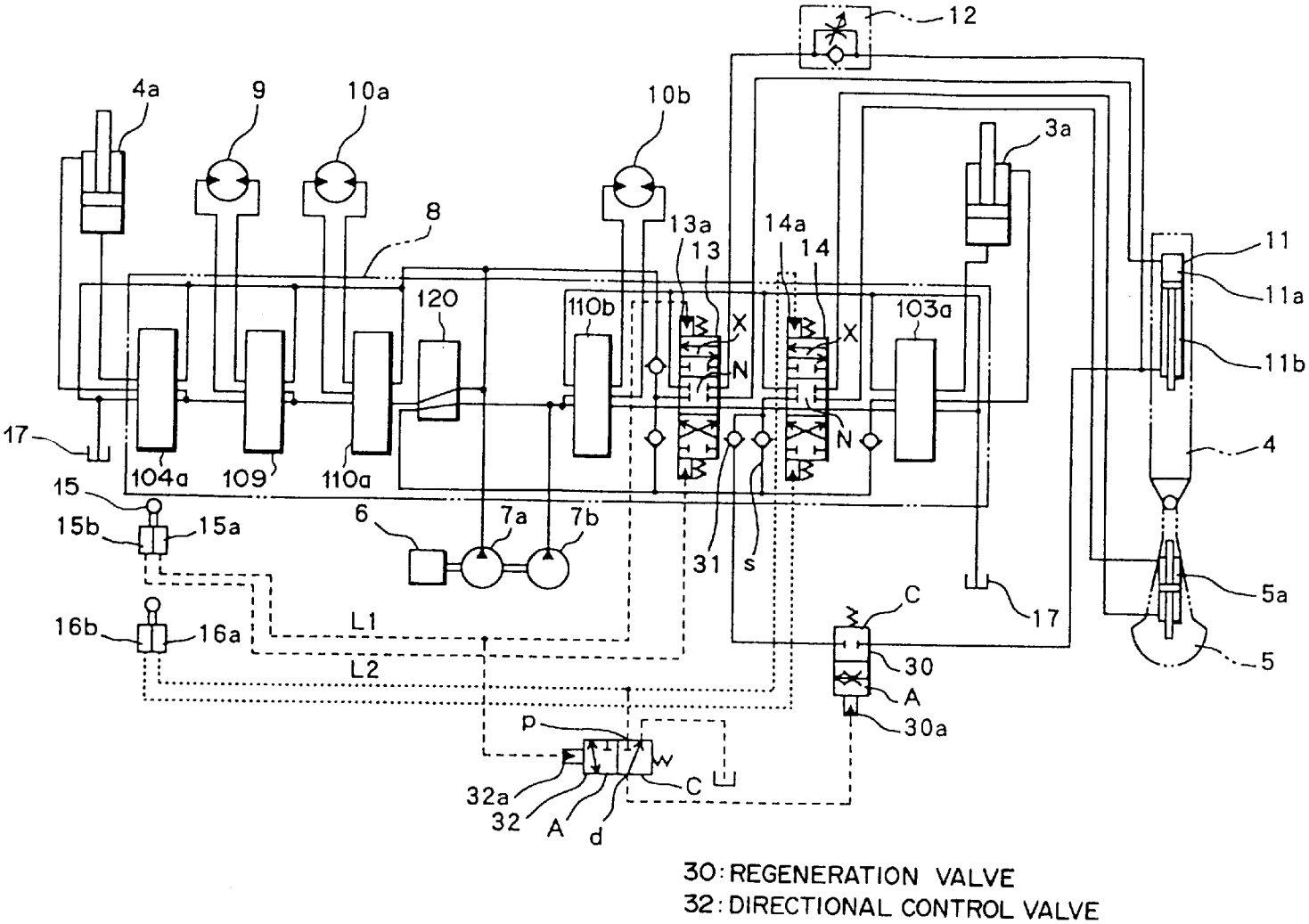
FIG. 4 is a schematic view showing a general configuration of a hydraulic circuit for a working machine according to a third embodiment of the present invention.
Figure 5:
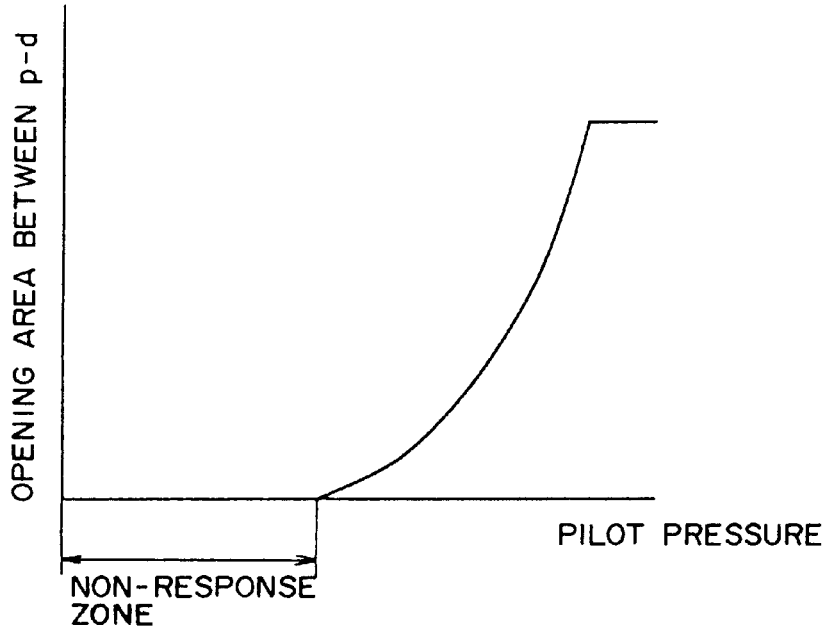
FIG. 5 is a diagram illustrating a control characteristic of the hydraulic circuit for a working machine according to the third embodiment of the present invention.
Figure 6:
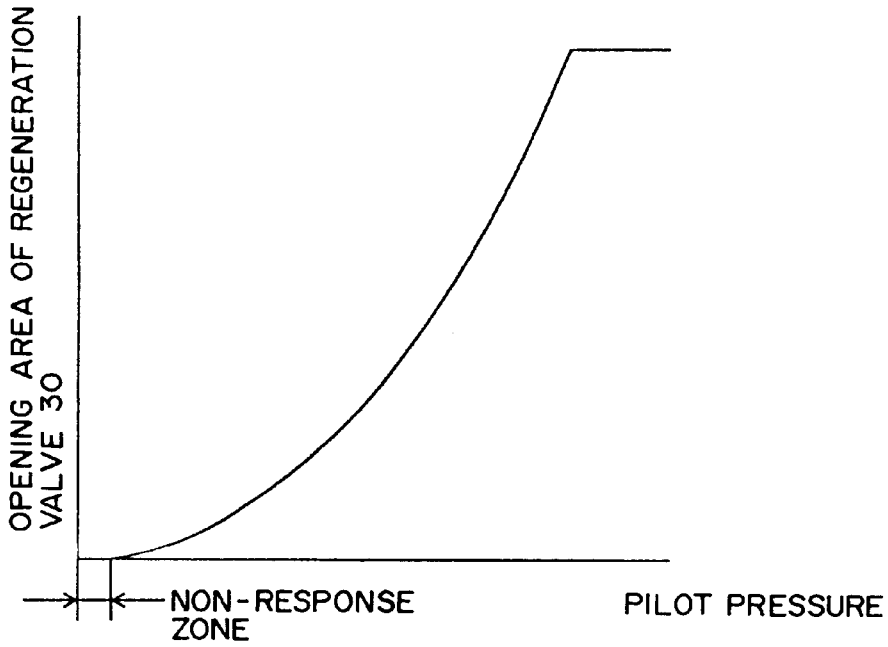
FIG. 6 is a diagram illustrating another control characteristic of the hydraulic circuit for a working machine according to the third embodiment of the present invention.

Now, a hydraulic circuit for a working machine according to a third embodiment of the present invention is described. FIG. 4 is a schematic view showing a general configuration of the hydraulic circuit, and FIGS. 5 and 6 are diagrams illustrating different control characteristic of the hydraulic circuit.

Also the hydraulic circuit of the present third embodiment has a basic configuration similar to that of the hydraulic circuit shown in FIG. 9, and elements described hereinabove with reference to FIG. 9 are denoted by like reference characters and description of them is omitted.

In the third embodiment of the present invention, the hydraulic circuit includes, as shown in FIG. 4, in addition to the configuration shown in FIG. 9, a regeneration valve 30 for introducing pressure oil of the rod side chamber 11*b* of the telescopic cylinder (working cylinder) 11 into an output pressure supply path s between the bucket control valve 14 and the pump 7*b*, a confluence check valve 31 interposed between the regeneration valve 30 and the bucket control valve 14, and a directional control valve 32 which is controlled to change over by the pilot pressure (operating pressure) of the telescopic remote control valve 15*a*.

The pilot pressure of the bucket remote control valve 16*a* is introduced to an input port p of the directional control valve 32, and an output port d is connected to a pilot port 30*a* of the regeneration valve 30.

The operation condition of the directional control valve 32 is controlled based on the pilot pressure when the telescopic cylinder 11 is driven to the expansion side, and the operation condition of the regeneration valve 30 is controlled in response to the operation condition of the directional control valve 32.

Then, in response to the operation condition of the regeneration valve 30, the operating oil (returning pressure oil) in the rod side chamber 11*b* of the telescopic cylinder 11 is supplied to the output pressure supply path s.

The hydraulic circuit for a working machine according to the third embodiment of the present invention is configured in such a manner as described above, and operation of the hydraulic circuit is described below separately for a case wherein the telescopic cylinder 11 operates by itself and another case wherein the telescopic cylinder 11 and the bucket cylinder 5*a* operate in an interlocking relationship.

(1) Operation of the Telescopic Cylinder by Itself

If the telescopic remote control valve 15*a* is opened, then the pilot pressure of the telescopic remote control valve 15*a* is introduced to the pilot port 13*a* of the telescopic control valve 13 through the pipe L1, and the telescopic control valve 13 is changed over from the chamber N to the chamber X. Further, the pilot pressure is supplied also to a pilot port 32*a* of the directional control valve 32 so that the directional control valve 32 is changed over from a chamber C to another chamber A.

Consequently, the pipe L2 for the pilot pressure of the bucket remote control valve 16*a* and the pilot port 30*a* of the regeneration valve 30 are connected to each other through the directional control valve 32.

When the bucket remote control lever 16 is not operated in the state described above, a pressure does not act upon the pilot port 30*a* of the regeneration valve 30, and consequently, the regeneration valve 30 is kept in a state illustrated in FIG. 4. Accordingly, when pressure oil of the hydraulic pumps 7*a*, 7*b* is supplied into the head side chamber 11*a* of the telescopic cylinder 11, then pressure oil in the rod side chamber 11*b* of the telescopic cylinder 11 is introduced into the tank 17 through the slow return valve 12 and the chamber X of the telescopic control valve 13 to expand the telescopic cylinder 11.

(2) Interlocking Operation of the Telescopic Cylinder and the Bucket Cylinder

When the bucket remote control valve 16*a* is opened in the state described above, the pilot pressure of the remote control valve 16*a* is introduced into the pilot port 30*a* of the regeneration valve 30 through the pipe L2 and the chamber A of the directional control valve 32 and functions as a pilot pressure (driving operating pressure) for the regeneration valve 30, and the regeneration valve 30 is changed over from the chamber C to the chamber A.

Consequently, the rod side chamber 11*b* of the telescopic cylinder 11 and the bucket control valve 14 are connected to each other. Meanwhile, since a high pressure is generated in the rod side chamber 11*b* by the weights of the multistage expansion arm 4 and the clamshell bucket 5 themselves, part of the pressure oil (returning oil) of the rod side chamber 11*b* is supplied to the bucket control valve 14 through the regeneration valve 30, confluence check valve 31 and output pressure supply path s.

Accordingly, only when the telescopic remote control valve 15*a* and the bucket remote control valve 16*a* operate in an interlocking relationship, pressure oil of the rod side chamber 11*b* of the telescopic cylinder 11 is supplied into the bucket cylinder 5*a*, and consequently, the speed at which the clamshell bucket 5 is opened can be increased.

It is to be noted that, if the bucket remote control lever 16 is operated when the telescopic cylinder 11 is operating at a low speed, then the regeneration valve 30 is placed into a communication state, and consequently, such a situation that the discharging flow rate of pressure oil of the rod side chamber 11*b* of the telescopic cylinder 11 increases suddenly and the pressure of the telescopic cylinder 11 decreases and then the speed of the telescopic cylinder 11 suddenly increases may possibly occur. Therefore, in the third embodiment of the present invention, in order to prevent such a situation as described above, the opening characteristic from the port p to the port d of the directional control valve 32 is set, for example, in such a manner as illustrated in FIG. 5.

In particular, the opening characteristic is set such that a region (non-response zone) wherein the port p and the port d are completely disconnected, when the pilot pressure of the telescopic remote control valve 15*a* is low, is provided and, when the pilot pressure increases, the opening area increases moderately in response to the increase of the pilot pressure.

It is to be noted that, while FIG. 5 exhibits such a characteristic that the opening area increases in a quadratic curve as the pilot pressure increases, the characteristic of the directional control valve 32 is not limited to that illustrated in FIG. 5, but may be any other characteristic if the characteristic is such that, at least when the pilot pressure becomes equal to or greater than a predetermined value, the opening area increases gradually in response an increase of the pilot pressure.

Where the characteristic of the directional control valve 32 is set in such a manner as described above, sudden expansion of the multistage expansion arm 4 can be prevented, and as the operating pressure for expanding the multistage expansion arm 4 increases, the clamshell bucket 5 can be opened rapidly as much.

Further, from a similar reason to that described hereinabove, also the characteristic of the regeneration valve 30 is set, for example, in such a manner as illustrated in FIG. 6. Inparticular, the characteristic of the regeneration valve 30 is set so that, when the pilot pressure of the bucket remote control valve 16*a* (the driving operating pressure acting upon the pilot port 30*a*) increases, the opening area of the regeneration valve 30 gradually increases accordingly.

Consequently, in a region wherein the driving operating pressure is low, sudden expansion of the multistage expansion arm 4 is prevented, and in another region wherein the driving operating pressure is high, the clamshell bucket 5 can be opened rapidly.

It is to be noted that also the characteristic of the regeneration valve 30 is not limited to that shown in FIG. 6 but may be modified in various manners as described hereinabove with reference to FIG. 5. Further, while, in the example illustrated in FIG. 6, a region (non-response zone) wherein the opening area of the regeneration valve 30 is zero, is provided within a range within which the pilot pressure is very low, such a non-response zone as just described need not be provided depending upon adjustment of the other design items.

Then, by suitably setting the characteristic of the directional control valve 32 and the regeneration valve 30 as described above, the variations in speed of the bucket cylinder 5*a* and the telescopic cylinder 11 can be moderated.

By the operation described above, when an operation for expanding the multistage expansion arm 4 and an operation for opening the clamshell bucket 5 are performed in an interlocked relationship, pressure oil of the telescopic cylinder 11 is supplied to the bucket cylinder 5*a*, and consequently, the opening speed of the clamshell bucket 5 can be raised without decreasing the expansion speed of the telescopic cylinder 11. Consequently, the subject described in the background art hereinabove that the speed at which the clamshell bucket 5 is opened is low can be eliminated and improvement of the operability can be achieved.

Further, since pressure oil of the telescopic cylinder 11 is supplied into the bucket cylinder 5*a*, it is not necessary to limit the pilot pressure of the telescopic control valve 13 to restrict the telescopic control valve 13 as in the first and second embodiments described hereinabove, and consequently, there is no necessity to increase the pump pressure to a level greater than a necessary level. Consequently, the hydraulic circuit is advantageous also in that energy saving can be anticipated and the operation efficiency can be improved.

(D) Description of the Fourth Embodiment

Figure 7:
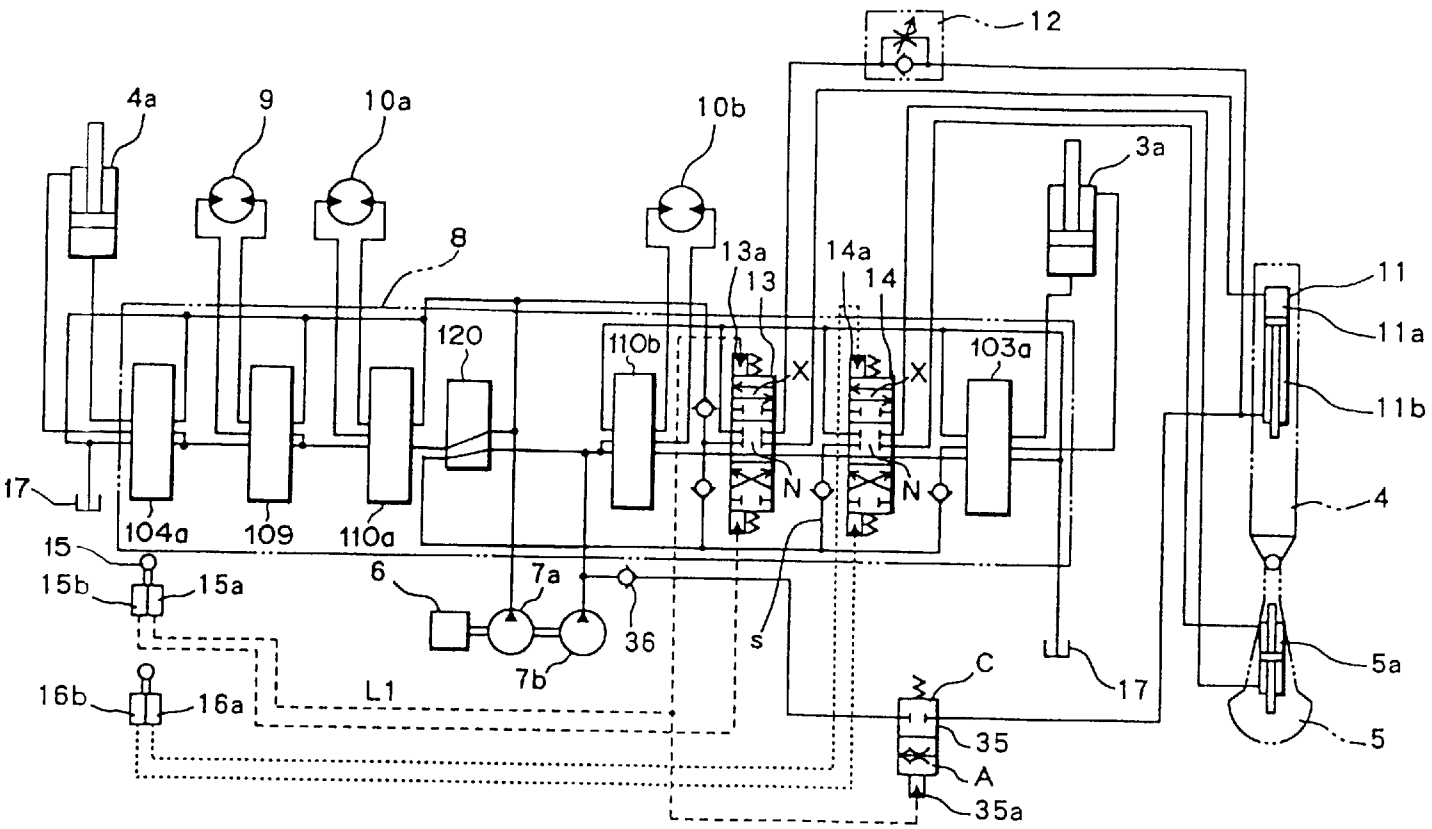
FIG. 7 is a schematic view showing a general configuration of a hydraulic circuit for a working machine according to a fourth embodiment of the present invention.
Figure 8:
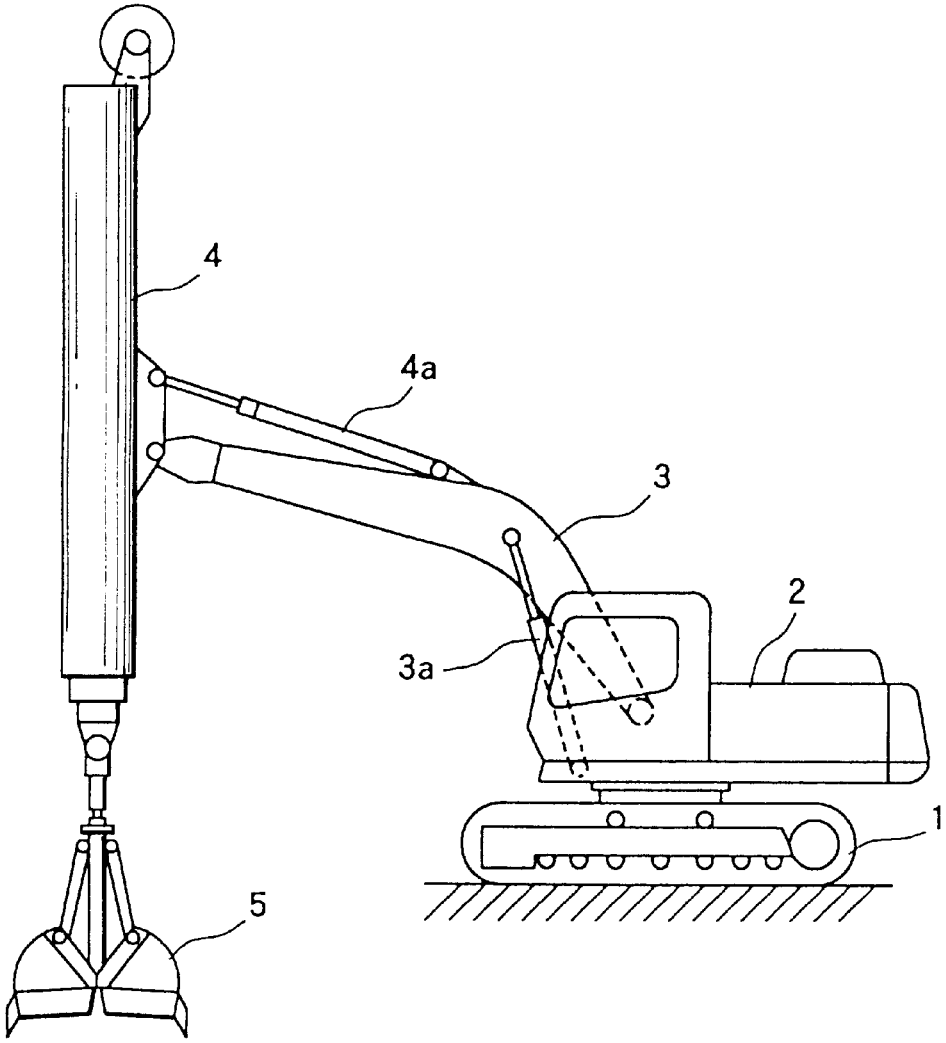
FIG. 8 is a schematic side elevational view showing a hydraulic excavator to which a common multistage expansion arm is attached.

Now, a hydraulic circuit for a working machine according to a fourth embodiment of the present invention is described. FIG. 7 is a schematic view showing a general configuration of the hydraulic circuit. Also the hydraulic circuit of the present fourth embodiment has a basic configuration similar to that of the hydraulic circuit shown in FIG. 9, and elements described with reference to FIG. 9 are denoted by like reference characters and description of them is omitted.

The hydraulic circuit in the fourth embodiment includes, as shown in FIG. 7, in addition to the configuration shown in FIG. 9, a regeneration valve 35 for merging pressure oil of the rod side chamber 11*b* of the telescopic cylinder 11 with the delivery side of the hydraulic pump 7*b*, and a confluence check valve 36 provided between the regeneration valve 35 and the delivery port of the hydraulic pump 7*b*. It is to be noted that, as shown in the figure, since the downstream side of the hydraulic pump 7*b* is connected to the output pressure supply path s of the clamshell bucket 5, it can be said that the regeneration valve 35 is provided between the cylinder 11 of the multistage expansion arm 4 and the output pressure supply path s of the clamshell bucket 5. The regeneration valve 35 is a directional control valve which normally disconnects the rod side chamber 11*b* and the delivery side of the hydraulic pump 7*b* from each other, but connects them to each other if a pilot pressure is supplied thereto, and a restrictor (orifice) is formed in the communication path.

Further, as shown in the figure, the pilot pressure supply pipe L1 of the telescopic remote control valve 15*a* is connected to a pilot port 35*a* of the regeneration valve 35.

The hydraulic circuit for a working machine according to the fourth embodiment of the present invention is configured in such a manner as described above, and operation of the hydraulic circuit is described below separately for a case wherein the telescopic cylinder 11 operates by itself and another case wherein the telescopic cylinder 11 and the bucket cylinder 5*a* operate in an interlocking relationship.

(1) Operation of the Telescopic Cylinder by Itself

If the telescopic remote control valve 15*a* is opened, then the pilot pressure from the telescopic remote control valve 15*a* is supplied to the pilot port 13*a* of the telescopic control valve 13 through the pipe L1, and the telescopic control valve 13 is changed over from the chamber N to the chamber X. The pilot pressure is introduced also to the pilot port 35*a* of the regeneration valve 35 so that the regeneration valve 35 is changed over from a chamber C to a chamber A. Consequently, the rod side chamber 11*b* of the telescopic cylinder 11 and the delivery side of the pump 7*b* are connected to each other through the regeneration valve 35.

Further, pressure oil from the hydraulic pumps 7*a*, 7*b* is supplied through the telescopic control valve 13 to the head side chamber 11*a* of the telescopic cylinder 11. Meanwhile, part of pressure oil in the rod side chamber 11*b* of the telescopic cylinder 11 is introduced into the tank 17 through the slow return valve 12 and the chamber X of the telescopic control valve 13 while the remaining pressure oil is merged with delivered pressure oil of the pump 7*b* through the regeneration valve 35 and the confluence check valve 36 and supplied into the control valve unit 8. Accordingly, since the pressure oil supplied to the head side chamber 11*a* of the telescopic cylinder 11 becomes greater than that of the hydraulic circuit shown in FIG. 9, the telescopic cylinder 11 can be expanded at a higher speed.

(2) Interlocking Operation of the Telescopic Cylinder and the Bucket Cylinder

If the bucket remote control valve 16*a* is opened in the state described above, then the pilot pressure of the bucket remote control valve 16*a* is introduced to the pilot port 14*a* of the bucket control valve 14 so that the bucket control valve 14 is changed over from the chamber N to the chamber X. Since a high pressure is generated in the rod side chamber 11*b* of the telescopic cylinder 11 by the weights of the multistage expansion arm 4 and the clamshell bucket 5 themselves, part of the pressure oil is supplied to the delivery side of the hydraulic pump 7*b* through the regeneration valve 35 and the confluence check valve 36, and consequently, the pump pressure becomes comparatively high.

Accordingly, since pressure oil which is greater than the delivery pressure of the hydraulic pumps 7*a*, 7*b* is supplied into the bucket cylinder 5*a* through the chamber X of the bucket control valve 14, the clamshell bucket 5 can be opened quickly.

By the operation described above, since part of pressure oil of the telescopic cylinder 11 is supplied to the pump delivery side, when the telescopic cylinder 11 operates by itself, the supply flow rate increases, and the hydraulic circuit of the present embodiment is advantageous in that the expansion speed of the telescopic cylinder 11 can be increased when compared with those of the hydraulic circuits of the embodiments described hereinabove.

Further, while, in the first and second embodiments, the speed of the telescopic cylinder 11 decreases when the operation for expanding the multistage expansion arm 4 and the operation for opening the clamshell bucket 5 are performed in an interlocking relationship, in the present embodiment, since pressure oil of the telescopic cylinder 11 is supplied to the delivery side of the pump 7*b*, the expansion speed of the telescopic cylinder 11 can be assured and the opening/closing speed of the clamshell bucket 5 can be increased. Accordingly, the hydraulic circuit of the present embodiment is advantageous in that the working speed can be increased and the subject that the opening speed of the clamshell bucket 5 is low can be eliminated and improvement in operability and working efficiency can be achieved.

(E) Others

The hydraulic circuit for a working machine of the present invention is not limited to those of the embodiments described above and various modifications are possible without departing from the spirit of the present invention. For example, the configuration of details and the control characteristic of the hydraulic circuit can be altered suitably in accordance with a change in design conditions, specifications of a model or the like.

INDUSTRIAL APPLICABILITY OF THE INVENTION

As described above, the hydraulic circuit for a working machine of the present invention is useful as a hydraulic circuit applied particularly to a working machine based on a hydraulic excavator and having a multistage expansion arm for caisson type excavation.

What is claimed is:

1. A hydraulic circuit for a working machine including an expansion arm and a clamshell bucket attached to a tip end of said expansion arm, said expansion arm and said clamshell bucket are driven by pressure oil supplied from a common pressure source, said hydraulic circuit comprising:

pressure reduction means reducing an expansion arm and operating pressure, which adjusts the pressure oil supplied to said expansion arm from the common pressure source to expand said expansion arm, based on a clamshell bucket operating pressure, which adjusts the pressure oil supplied to said claimshell bucket from the common pressure source, to open said clamshell bucket.

2. The hydraulic circuit for a working machine as set forth in claim 1, said pressure reduction means including:

first pressure reduction means, and second pressure reduction means, said first pressure reduction means for branching and reducing the claimshell bucket operating pressure and outputting the reduced operating pressure to said second pressure reduction means, said second pressure reduction means for reducing the expansion arm operating pressure based on the reduced pressure outputted from said first pressure reduction means.

3. The hydraulic circuit for a working machine as set forth in claim 1, said pressure reduction means including;

operating pressure detection means for detecting the clamshell bucket operating pressure, and third pressure reduction means for reducing the expansion arm operating based on the detected clamshell operating pressure received from said operating pressure detection means.

4. The hydraulic circuit for a working machine as set forth in claim 3, wherein said third pressure reduction means reduces the expansion arm operating pressure in accordance with an increase of the clamshell bucket operating pressure detected by said operating pressure detection means.

5. A hydraulic circuit for a working machine including an expansion arm having an expansion arm working cylinder and a clamshell bucket attached to a tip end of said expansion arm and having a clamshell bucket working, said expansion arm and said clamshell bucket being driven by pressure oil supplied into the expansion arm working cylinder and the clamshell bucket working cylinder, respectively, said hydraulic circuit comprising:

a regeneration valve connected between said expansion arm working cylinder of said expansion arm and an output pressure supply path, in which the pressure oil is supplied into the clamshell bucket working cylinder to open said clamshell bucket, said regeneration valve for selectively supplying returning pressure oil, which is outputted from said expansion arm working cylinder to said output pressure supply path when said expansion arm is expanded; and a directional control valve for actuating said regeneration valve in response to an expansion arm operating pressure, which adjusts the pressure oil supplied to said expansion arm working cylinder of said expansion arm, by supplying the expansion arm operating pressure, as a regeneration valve actuating pressure, to the regeneration valve.

6. The hydraulic circuit for a working machine as set forth in claim 5, wherein said directional control valve actuates said regeneration valve in such a manner that if the expansion arm operating pressure is equal to or smaller than a predetermined pressure, the regeneration valve actuating pressure is not supplied to said regeneration valve.

7. The hydraulic circuit for a working machine as set forth in claim 6, wherein said directional control valve actuates said regeneration valve in such a manner that if the expansion arm operating pressure is equal to or greater than the predetermined pressure, the regeneration valve actuating pressure, which is to be supplied to said regeneration valve, increases as the expansion arm operating, pressure increases.

8. The hydraulic circuit for a working machine as set forth in claim 5, wherein said regeneration valve supplies the returning pressure oil from said expansion arm working cylinder to said output pressure supply path in such a manner that when the regeneration valve actuating pressure increases, flow of the returning pressure oil is increased.

9. A hydraulic circuit for a working machine including an expansion arm and a clamshell bucket attached to a tip end of said expansion arm, said hydraulic circuit comprising:

a regeneration valve connected between an expansion arm working cylinder of said expansion arm and an output pressure supply path, in which the pressure oil is supplied into a clamshell bucket working cylinder of said clamshell bucket, said regeneration valve selectively supplies returning pressure oil, which is outputted from said expansion arm working cylinder to said output pressure supply path, when said expansion arm is expanded;

said regeneration valve being controlled based on an operating pressure for controlling said expansion arm to expand said expansion arm.

* * * * *